United States Patent [19]

Hibbitts

[11] 4,407,306

[45] Oct. 4, 1983

[54] METHOD FOR EXPANDING TOBACCO WITH STEAM AT HIGH TEMPERATURE AND VELOCITY

[75] Inventor: Charles H. Hibbitts, Chester, Va.

[73] Assignee: American Brands, Inc., New York, N.Y.

[21] Appl. No.: 331,676

[22] Filed: Dec. 17, 1981

[51] Int. Cl.[3] ..... A24B 3/18

[52] U.S. Cl. ..... 131/296; 131/302; 131/303; 131/304; 131/306

[58] Field of Search ..... 131/291, 296, 302, 303, 131/304, 306

[56] References Cited

U.S. PATENT DOCUMENTS

| | | | |
|---|---|---|---|
| 3,357,436 | 12/1967 | Wright | 131/303 |
| 3,575,178 | 4/1971 | Stewart | 131/296 |
| 3,678,939 | 7/1972 | Key et al. | 131/304 |
| 3,734,104 | 5/1973 | Buchanan et al. | 131/296 |
| 4,044,780 | 8/1977 | Kelly | 131/303 |

*Primary Examiner*—V. Millin

*Attorney, Agent, or Firm*—Pennie & Edmonds

[57] ABSTRACT

A method is disclosed for drying and expanding cut tobacco by introducing the tobacco into an elongated tubular shaped conduit through which high temperature, high velocity superheated steam is recycled. The conduit has a reduced area section into which the tobacco is introduced and provision is made to allow recycle of steam and hence minimal energy consumption.

3 Claims, 3 Drawing Figures

METHOD FOR EXPANDING TOBACCO WITH STEAM AT HIGH TEMPERATURE AND VELOCITY

BACKGROUND ART

Prior techniques for expanding cut tobacco containing an elevated moisture level using hot fluids have included Wright U.S. Pat. No. 3,357,436 which employs hot air; Buchanan U.S. Pat. No. 3,734,104 which uses hot gases and Kelly U.S. Pat. No. 4,044,780, also teaching the use of hot gases, is owned by the assignee of the present application.

While prior methods have been directed to accomplishing expansion of the tobacco while being conveyed in gaseous fluids, none has employed the particular conditions of temperature, velocities or use of heated fluid and process conditions of the present invention.

SUMMARY OF THE INVENTION

Broadly, the present invention is a method for treating cut tobacco to expand it in which a high velocity stream of high temperature, superheated steam is established in a conduit having venturi and subsequent treatment sections. Tobacco is introduced into the venturi section and, during its rapid transport by the stream in the venturi section and subsequent treatment section, is expanded. The diameter, length and stream flow are selected so that processing time in the tobacco treatment sections is substantially less than one second.

It is a feature of the invention that acceleration and speed of tobacco travel from its entrance into the conduit until its discharge is such that the tobacco never reaches the speed of the stream. Accordingly this difference in speed of the tobacco and the conveying gaseous medium causes the surface of the tobacco shreds to be exposed constantly to new high temperature steam.

It is a further feature that the tobacco is expanded an acceptable amount without degradation or substantial diminution in size.

An additional important feature of this method is that it is continuous and will conveniently allow most of the energy reservoir in the form of hot steam to be recycled.

DESCRIPTION OF THE PREFERRED EMBODIMENT

Figure 1:
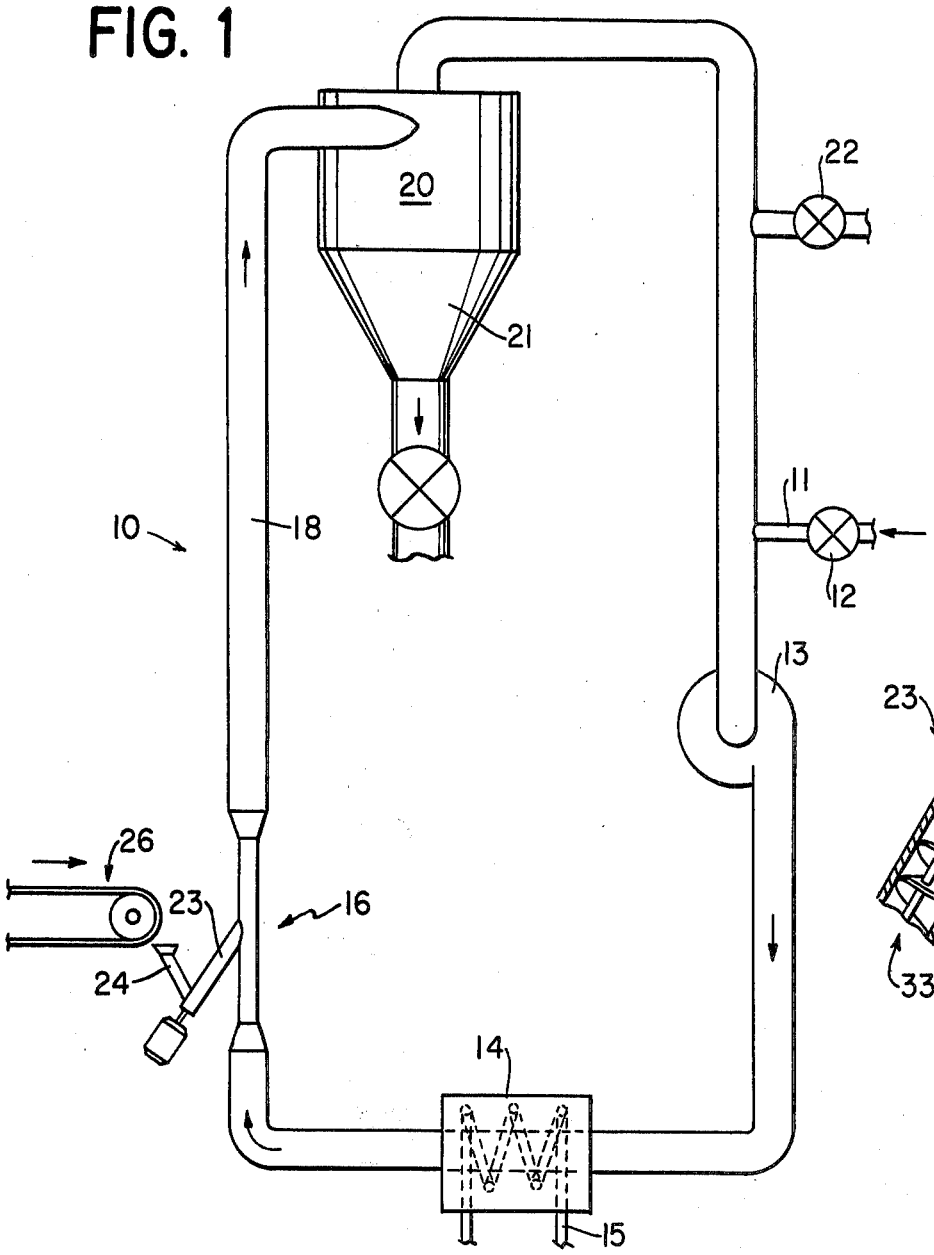
FIG. 1 is an elevational view of the conduit loop system used in practicing the invention.

Referring to FIG. 1, conduit loop 10 is supplied with steam through steam line 11 having steam valve 12 in it. Steam passing into loop 10 is moved by blower 13 through heater box 14 having heating elements 15 therein.

The heated steam then enters venturi tobacco treatment section 16 and after exiting section 16 enters tobacco drying and expanding section 18 for further treatment. The sections of the loop 10 through which tobacco flows, sections 16 and 18, are herein referred to as the tobacco treatment sections. After travel through the tobacco treatment sections, including section 18, the tobacco and steam are separated in tangential separator 20 with the tobacco exiting the conical section 21 of separator 20 while the steam and other included gases in the stream continue to circulate in loop 10. Steam is fed into the loop as necessary to maintain a sufficient amount of steam in the system and, if excess pressure builds, relief valve 22 opens to reduce the pressure. Tobacco is introduced into the loop 10 through tube and screw feeder 23 which in turn is fed through hopper feed supply chute 24. Hopper chute 24 is supplied with tobacco from a belt or other conveyor 26.

Figure 2:
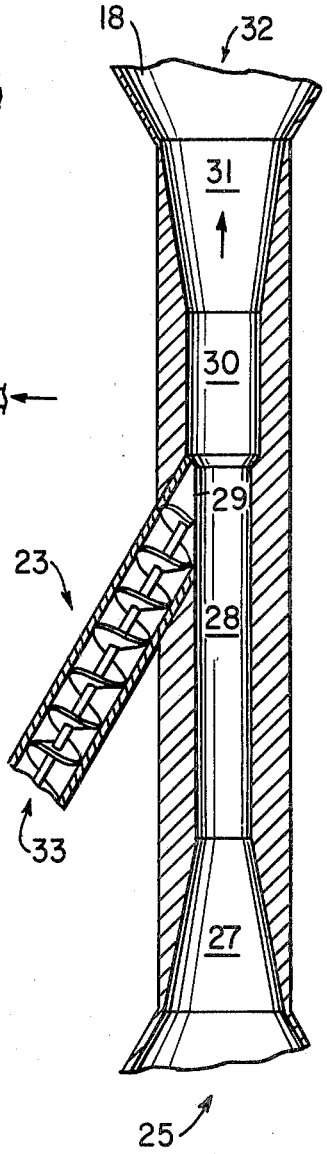
FIG. 2 is an enlarged sectional view of the venturi section of the loop which section receives the tobacco.
Figure 3:
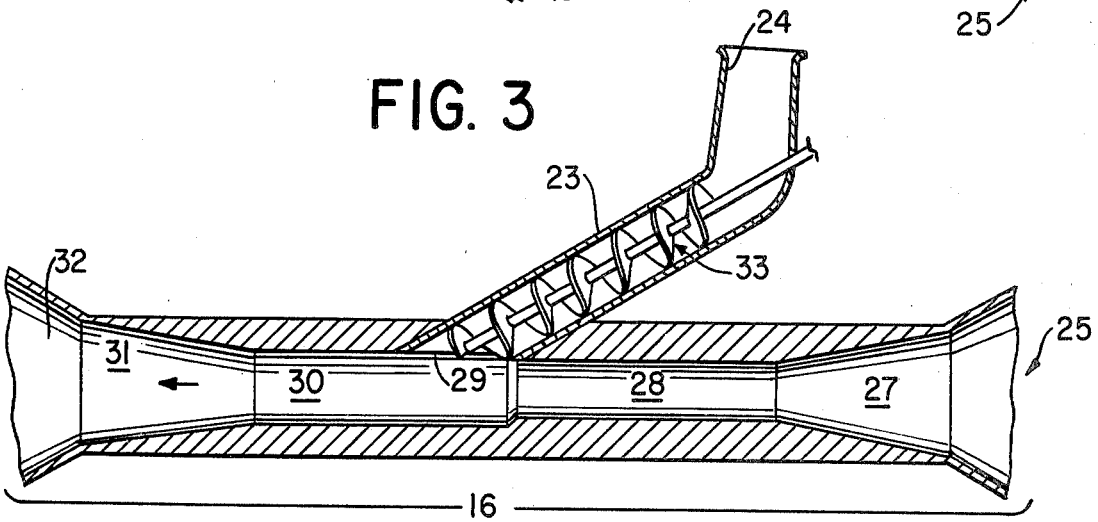
FIG. 3 is an alternative embodiment in which the venturi section is positioned horizontally.

Turning to FIGS. 2 and 3, venturi section 16 includes an entrance transition piece 25, entrance funnel area 27, first flow-restricted portion 28, tobacco feed entrance 29 and second flow-restricted portion 30 having a diameter greater than first flow-restriction portion 28. Exit funnel area 31 leads to and connects with the drying and expanding section 18 through exit transition piece 32. Tube and screw feeder 23 includes rotatable auger 33 for transporting the tobacco through entrance 29 located in restricted portion 30. FIG. 3 differs from FIG. 2 in that section 16 is horozontally positioned and entrance 29 is in portion 28 in FIG. 2 but is in portion 30 in FIG. 3. Portions 28 and 30 may be shaped to have substantially the same flow restrictive characteristics. Hopper supply chute 24 is also vertically positioned and shaped in FIG. 2 which serves as a vertically positioned venturi section while in FIG. 3 serves as a horizontal venturi section.

The amount of steam introduced into heater box 14 is such that the flow rate of steam exiting therefrom is more than 100 feet per second and often in excess of 150 feet per second thus causing a substantial reduction in pressure in venturi section 16 as the steam flows through that section. For example, pressure in venturi section 16 with steam flowing through the conduit (with feed chute 24 sealed off to prevent air or tobacco introduction( is about 250 mm of mercury (Hg) below atmospheric pressure. Tobacco flow is conveniently provided by the screw feeder which serves well to restrict the influx of air with the tobacco. Steam may also be fed into screw conveyor 23 with the tobacco to further reduce the amount of air introduced into this system. Steam flow is established in the system before the tobacco is fed to venturi section 16. As the tobacco is fed into the high speed column of steam (and minor amounts of air), tobacco particles start accelerating as they enter the column of gas and continue to accelerate as they move through the column. With a header pressure of 15 psig and utilization of conduits approximately an inch in diameter and twelve (12) feet long, tobacco residence time in the venturi and treatment sections 16 and 18 is about one quarter of a second. Tobacco leaving conduit 18 is delivered into a tangential (or other suitable separator) 20. Little or no further steam addition is required since water removed from the tobacco is converted into steam.

In the operation of this method, the speed of the gas flow through the treatment conduit sections is greater than the speed of the tobacco particles providing relative movement between the steam and tobacco. This relative movement causes the tobacco particles to be continually bathed with fresh hot steam thereby providing rapid drying and expansion of the tobacco. As the tobacco travels in the conduit from the venturi entrance to the tobacco exit, it is constantly accelerated as it progresses in the loop. Preferably, the length of tobacco travel should be such that the tobacco exits before it reaches the speed of the gases. While the process equipment is preferably designed to provide for recycle of most of the hot steam required to dry and expand the tobacco, a non-recycling or batch system may be used. Once started a loop system may operate through additions of tobacco minimal amounts of steam and thermal energy.

EXAMPLE 1

A series of samples of cut tobacco each weighing about 200 g and at varying moisture contents was expanded using 650°-700° F. temperature steam in tandem tobacco treatment section which sections have a diameter of about one inch (except for the reduced-diameter venturi section) and a length of about 12 feet. The venturi pressure was about 90-200 mm Hg below atmospheric pressure through adjustment of the velocity of the gas stream. Data are in Table I below.

TABLE I

| Sample No. | Moisture, % Before Expansion | Filling Power, cc/g Corrected to 12% Moisture | Increase in Filling Power % |
|---|---|---|---|
| 7 | 24.7 | 7.6 | 49 |
| 2 | 26.7 | 7.5 | 47 |
| 3 | 30.0 | 7.9 | 55 |
| 4 | 30.8 | 7.7 | 51 |
| 5 | 31.6 | 8.0 | 51 |
| 6 | 32.4 | 8.2 | 61 |
| 10 | 39.9 | 8.3 | 63 |
| 11 | 42.8 | 8.4 | 65 |
| 12 | 44.1 | 8.2 | 61 |
| 13 | 48.5 | 8.3 | 63 |
| 14 | 46.0 | 8.1 | 59 |
| Control | 12.0 | 5.1 | — |

EXAMPLE 2

A Tobacco blend was adjusted to 32.5% moisture and expanded using steam in the 500°-700° F. temperature range. Venturi pressure was reduced about 80-120 mm Hg below atmospheric pressure. Filling power of the expanded tobacco was 6.7 cc/g which represents a 31% expansion.

EXAMPLE 3

Another quantity of tobacco having a 19% moisture content was cut and the moisture content increased to 30.8% before expansion. The temperature of the steam was 630°-670° F. and the venturi pressure was reduced 100 mm Hg below atmospheric. The expanded tobacco was stored under high humidity and temperature conditions. After storage, its moisture was 19.5% and its filling power increased due to expansion was 20% over the control with corrections made to 12% moisture basis.

EXAMPLE 4

Moisture content of a tobacco blend was raised to 24.6% and expanded with steam at 580°-650° F. using a 80-120 mm Hg pressure drop at the venturi. The tobacco was expanded 21%.

EXAMPLE 5

Another blend was cut at 20% moisture and then raised to 29.5% moisture. The tobacco was expanded with steam at 600°-700° F. and a venturi pressure 80-120 mm Hg below atmospheric pressure. Filling power, corrected to 12% moisture, was 5.0 cc/g which is 28% expansion.

EXAMPLE 6

Another blend of tobacco was cut at 18.5% moisture content and then raised to 30% moisture. This tobacco was fed at 125 lbs./hr. to a suitable sized venturi entrance. Steam temperature in the expansion conduit was 650 and 600° F. at the inlet and outlet, respectively. Steam flow rate in the expansion conduit was essentially 175 ft/sec. During processing the tobacco moisture content was reduced to approximately 12% and filling power of the tobacco was increased by average of about 50%.

I claim:

1. A method for drying and expanding cut tobacco comprising
   (a) providing a stream of gas including steam and air moving at a speed in excess of 100 ft./sec. at a temperature in the range of 500°-700° F. at about atmospheric pressure in an elongated conduit having first and second sections tandemly arranged with the first section having a reduced cross-sectional area so that as the gas passes through said reduced area the pressure at that area is decreased;
   (b) introducing cut tobacco having 15-50% moisture content into such reduced pressure area of the first section of the conduit for high speed transport through the first and second sections;
   (c) withdrawing the tobacco from the conduit after it has resided therein less than one half second.

2. The method of claim 1 in which the length of the elongated conduit, the cross-sectional dimensions of said conduit, the volume of gases introduced therein and the volume of tobacco feed are controlled so that tobacco speed in the conduit is less than the gas speed during the tobacco treatment.

3. A method for drying and expanding tobacco comprising the use of
   (a) a conduit having two tandemly positioned tobacco treatment sections with the first section having a cross sectional area substantially smaller than the cross sectiona area of the second section;
   (b) such first section composed of two zones tandemly arranged with the second zone larger than the first zone;
   (c) a steam header having a cross sectional area essentially the same as that of the second section communicating with the first section to supply superheated steam to the first section;
   (d) a tobacco feed inlet means, connected to the second zone of the first section; and
   (e) provision to recycle essentially all the steam.

* * * * *